US005759326A

United States Patent [19]

Vigneau

[11] Patent Number: 5,759,326

[45] Date of Patent: Jun. 2, 1998

[54] METHOD AND APPARATUS FOR HANDLING LOGS OF CONVOLUTELY WOUND WEBS

[75] Inventor: Richard J. Vigneau, Green Bay, Wis.

[73] Assignee: Paper Converting Machine Company, Green Bay, Wis.

[21] Appl. No.: 822,862

[22] Filed: Mar. 24, 1997

Related U.S. Application Data

[63] Continuation-in-part of Ser. No. 575,908, Dec. 20, 1995, which is a continuation-in-part of Ser. No. 437,810, May 9, 1995, Pat. No. 5,573,615.

[51] Int. Cl.[6] ..... B65H 18/00

[52] U.S. Cl. ..... 156/191; 156/187; 156/193; 156/449; 156/578; 242/533

[58] Field of Search ..... 156/184, 187, 156/191, 193, 446, 448, 449, 450, 456, 458, 578; 118/243; 242/533

[56] References Cited

U.S. PATENT DOCUMENTS

| | | | |
|---|---|---|---|
| Re. 30,598 | 5/1981 | Spencer . | |
| 3,179,348 | 4/1965 | Nystrand et al. . | |
| 3,926,299 | 12/1975 | Bradley et al. . | |
| 4,828,195 | 5/1989 | Hertel et al. . | |
| 5,226,611 | 7/1993 | Butterworth et al. | 242/533 X |
| 5,242,525 | 9/1993 | Biagiotti . | |
| 5,259,910 | 11/1993 | Biagiotti . | |

*Primary Examiner*—James Engel

*Attorney, Agent, or Firm*—Tilton, Fallon, Lungmus & Chestnut

[57] ABSTRACT

A method and apparatus for handling logs of convolutely wound webs which includes providing a rewinder-tail sealer wherein a glue stripe is applied to a predetermined circumferential location on a partially unwound log and the log rewound by rolling on itself toward and into a pair of spaced-apart rollers, providing a path from the roller pair to log receiver wherein logs sequentially roll in the path, the path having fixed dimensions, operating the rewinder-tail sealer to develop logs of a first nominal diameter to enable the roller pair to controllably rotate each log for positioning the glue stripe at a first angular orientation, which in combination with the fixed dimensioned path enables each log to be received in the receiver with its glue stripe in a second angular orientation, changing the operation of the rewinder to develop logs of a second nominal diameter, and by correlating the second nominal diameter with the fixed dimensioned path to enable each second nominal diameter log to be received in said receiver with its glue stripe in the second angular orientation and adjusting the spacing between the roller pair to be slightly less than the second nominal diameter.

22 Claims, 4 Drawing Sheets

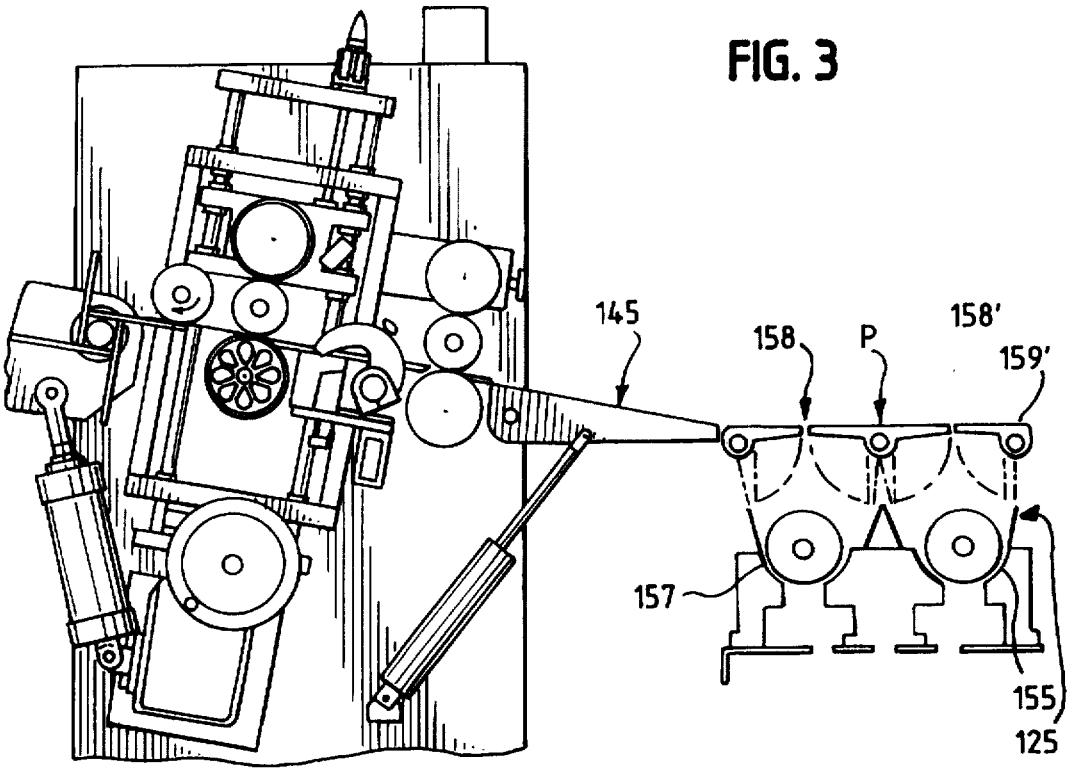
FIG. 3
FIG. 4
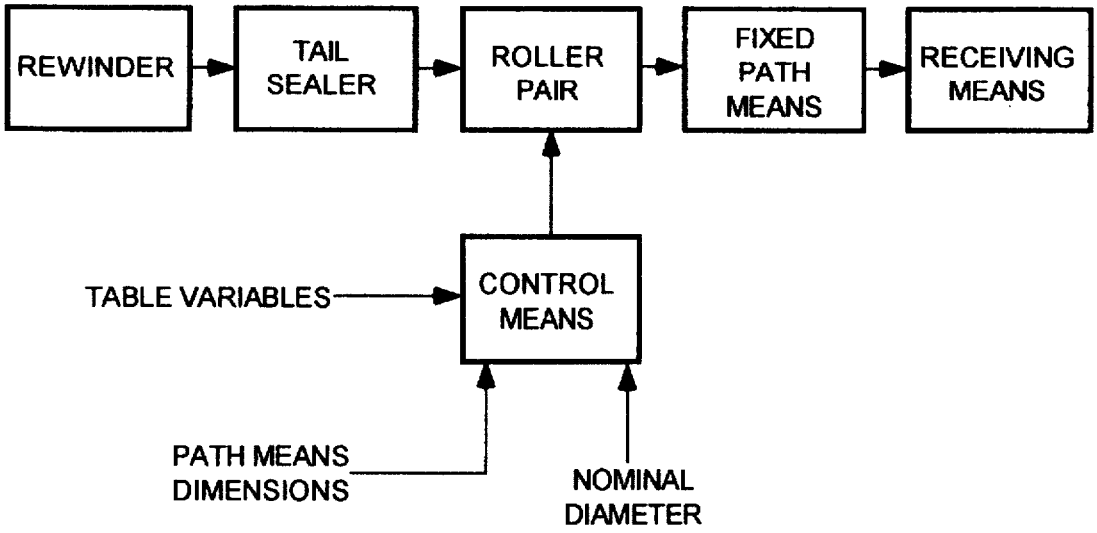

METHOD AND APPARATUS FOR HANDLING LOGS OF CONVOLUTELY WOUND WEBS

This application is a continuation-in-part application of application Ser. No. 08/575,908 filed Dec. 20, 1995 which in turn was a continuation-in-part of application Ser. No. 08/437,810, filed May 9, 1995 now U.S. Pat. No. 5,573,615.

BACKGROUND AND SUMMARY OF INVENTION

This invention relates to method and apparatus for handling logs of convolutely wound webs and, more particularly, to elongated logs such as are produced in manufacturing bathroom tissue and kitchen toweling products.

The invention features a method and apparatus for positioning the finished wound tail seal logs tail for any given diameter, so that when the log reaches a predetermined downstream apparatus such as an accumulator, log saw or other receiving means, the tail is positioned in a predetermined angular orientation—and this without operator interface, i.e., manual adjustment.

In all present tail seals, the tails are detected for the purpose of locating the glue relative to the leading edge of the tail. After the glue has been applied, the log is typically wound-up one revolution to press the tail and glue together. See U.S. Pat. No. 5,242,525 and 5,259,910 for wind-up stations with two rollers along with the above co-owned application Ser. No. 08/575,908.

The problem with this random wind-up of the tail is with downstream equipment. This is because the tail glue line usually penetrates through the tissue layers and can stick to other equipment if left in contact for even a short period of time. Downstream equipment such as an accumulator where the tail can happen to stop on a supporting member will often stick, resulting in the tail seal breaking open when the log is discharged from the accumulator. The residence time of a log in an accumulator can range from a few minutes to several hours—thereby exacerbating the sticking problem.

To solve this problem on some tail seals it has been common practice to provide an adjustable timer to control just how long a log rotates in the discharge rollers before it is discharged to the downstream apparatus. Typically, the operator observes the final tail position as it reaches the downstream equipment and then makes an adjustment to advance or retard the position by changing the timer. This interface normally remains constant until the product diameter is changed, at which time the operator must again make adjustments to locate the tail. Until now, this repetitive step by the operator every time the product diameter is changed takes valuable operating time to set up.

The instant invention utilizes two rollers with independent drives and control logic to position the final tail position accurately when seated in the next downstream apparatus—and without operator interface. More particularly, the inventive method and apparatus include the steps of (a) providing of a rewinder-tail sealer wherein a glue stripe is applied to a predetermined circumferential location on a partially unwound log and the log rewound by rolling on itself toward and into a pair of spaced-apart rollers; (b) providing path means from the roller pair to log receiving means wherein logs sequentially roll in the path means and where the path means has fixed dimensions; (c) operating the rewinder-tail sealer to develop logs of a first nominal diameter wherein the roller pair spacing is slightly less than the nominal diameter to enable the roller pair to controllably rotate each log for positioning the glue stripe at a first angular orientation—which in combination with the fixed dimensioned path means enables each log to be received in the receiving means with its glue stripe in a second angular orientation; (d) changing the operation of the rewinder to develop logs of a second nominal diameter and prior to the introduction of the second nominal diameter logs into the tail sealer; (e) correlating the second nominal diameter with the fixed dimensioned path means to enable each second nominal diameter log to be received in the receiving means with its glue stripe in the second angular orientation, and (f) adjusting the spacing between the roller pair to be slightly less than the second nominal diameter.

The invention is particularly advantageous in connection with the structures of the above-identified patents and application. Other advantages and objects of the invention may be seen in the ensuing specifications and claims.

BRIEF DESCRIPTION OF DRAWING

The invention is described in conjunction with the accompanying drawing, in which

FIG. 3 is a fragmentary view similar to the right hand portion of FIG. 1 but showing the tail sealer in combination with the conveyors of a log saw;

FIG. 4 is a block diagram of the operation of the invention with certain structural features being designated.

DETAILED DESCRIPTION

Figure 1:
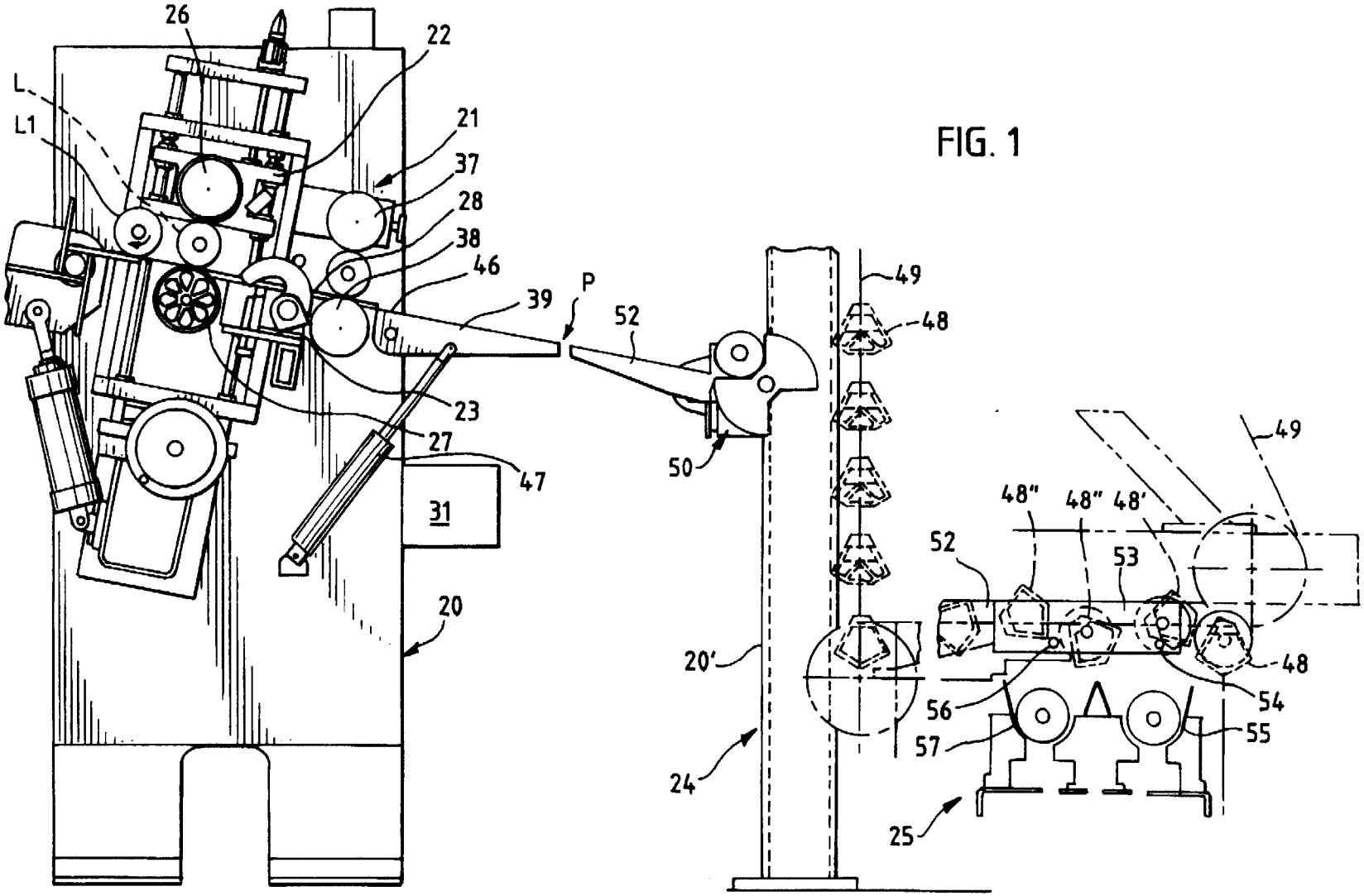
FIG. 1 is a side elevational view of a tail sealer-log accumulator-log-saw incorporating teachings of the instant invention.
Figure 2:
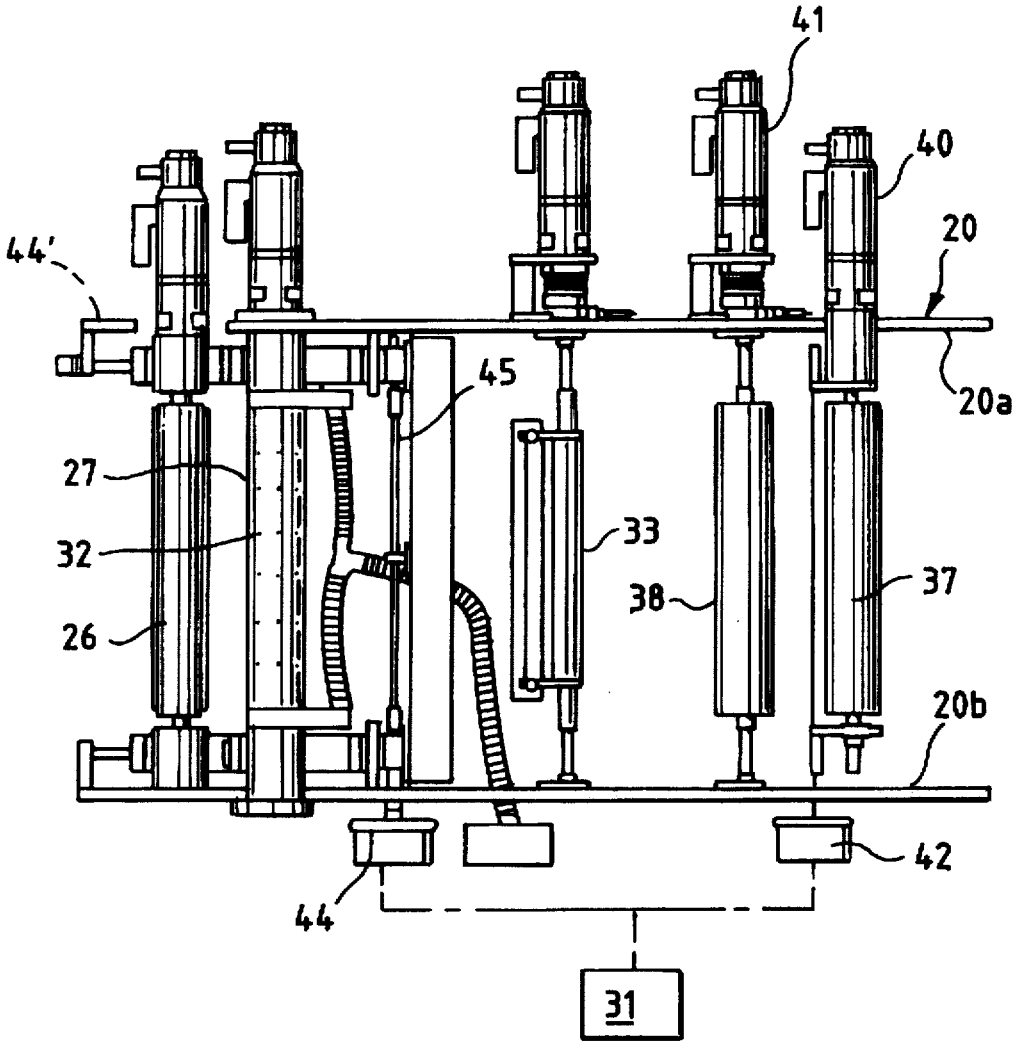
FIG. 2 is a developed top plan view of the structure of FIG. 1, i.e., with the various rollers "spread out" so as not to be one above the other.

Referring first to FIG. 1, the numeral 20 designates generally the frame of the tail sealing apparatus which includes side frames **20*a* and 20*b* as seen in FIG. 2. As is brought out in greater detail in the above-identified application, the tail sealer generally designated 21 herein has tail positioning means as at 22 and glue applying means as at 23. Reference may be had to the above-identified application for additional details. However, the sequence of operation will be explained briefly hereinafter with respect to FIGS. 5–10**.

Proceeding to the right in FIG. 1, the numeral 24 designates generally an accumulator which advantageously may be of the type described in co-owned U.S. Pat. No. 3,926,299. The accumulator provides one form of receiving means which is advantageously employed in the practice of the invention.

Proceeding further to the right in FIG. 1, the multiple conveyor troughs of a log saw are designated generally by the numeral 25. Advantageously, the troughs and the environmental log saw may take the form of those described in co-owned U.S. Pat. No. RE 30,598—and reference also may be had thereto for additional details not disclosed herein. Further, the trough means 25 of the log saw seen in FIG. 1 may also be a receiving means if utilized in the manner depicted at 125 in FIG. 3.

TAIL SEALER

The instant invention, as indicated above, applies generally downstream of the tail sealer 21. Therefore, only a brief summary of the structure and operation of the tail sealer is presented herein and, again, reference may be had to the above-identified application for additional details.

Figure 5:
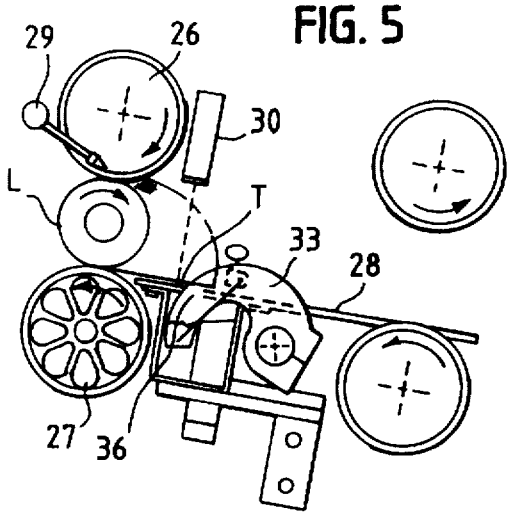
FIGS. 5–10 are fragmentary somewhat schematic side elevational views showing the progress of a log through the tail sealer akin to that described in greater detail in the above-identified application.
Figure 6:
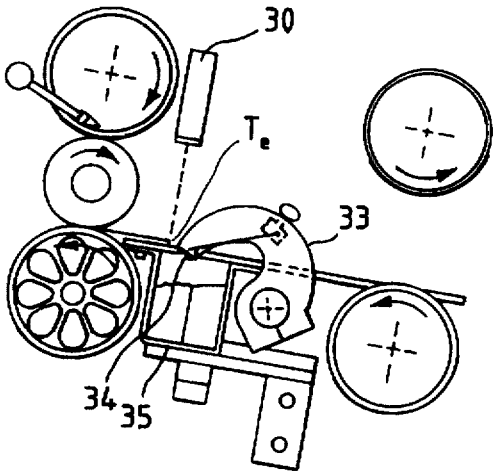
Figure 7:
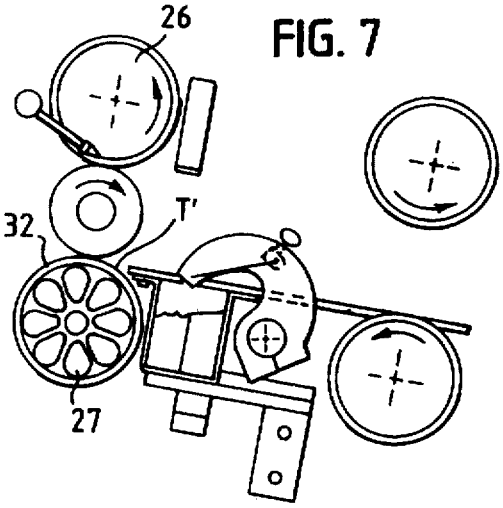
Figure 8:
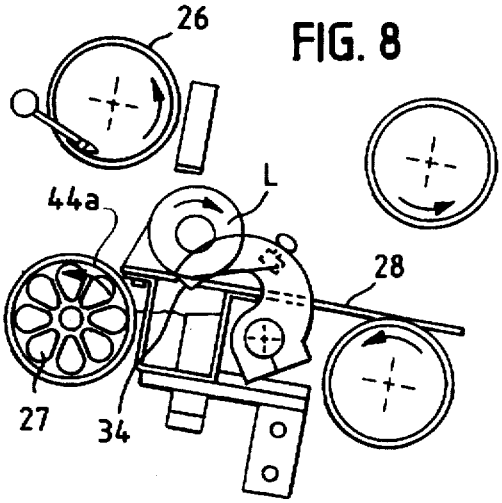
Figure 9:
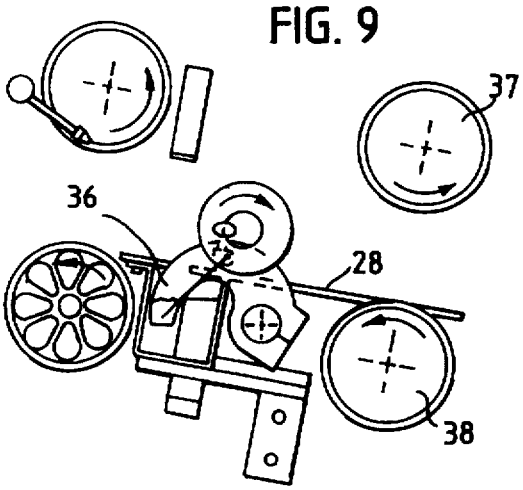

The tail sealer is equipped with a pair of drums 26 and 27 which also can be seen in FIG. 5. There, a log L is seen to be in the process of having its tail T blown down onto a table 28 by virtue of an air blast 29. The tail is in the process of being sensed by a photo eye detector 30. As seen in FIG. 6, the detector 30 has detected the tail end $T_e$. A signal is then sent to the control means 31—see the right hand portion of the frame 20—the rotation of the drum 26 is reversed to counterclockwise as illustrated in FIG. 7. This results in unwinding a predetermined amount of tail as at T' in FIG. 7—the tail being held against the lower drum 7 by means of vacuum ports 32. As the roller 26 continues to rotate, the log L is ejected from between the drums 26, 27 and onto the table 28 as seen in FIG. 8.

Meanwhile, the glue-applying means 33 (see FIG. 5) has rotated clockwise to the FIG. 6 position where a wire element 34 (which carries glue from the glue canister 35) is positioned level with a slot 36 in the table 28—see FIG. 5.

Figure 10:
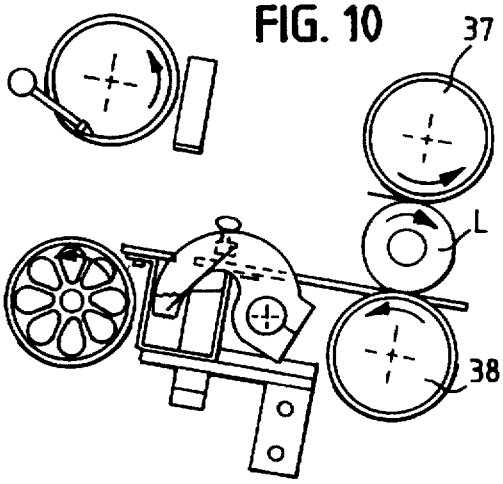

Now, as seen in FIG. 3, the log L is in the process of rolling over the wire 34 to pick up glue and then continues its rolling down the table 28 until it comes between upper and lower rollers 37 and 38, respectively as seen in FIG. 10.

INVENTION OPERATION—GENERALLY

In the operation of the invention, the log passes into the tail sealer 21 and the tail is located and positioned. From this point on, the tail position is known and all following operations are executed in a series of programmed steps based upon (a) the log diameter and (b) the final position the log is to reach.

Once the tail has been located and positioned for glue application, the log is then ejected or conveyed over the glue applicator. After glue has been applied, the log is rolled forward the discharge rollers 37 and 38. This takes a fixed amount of time based upon the diameter of the log and the rotational speed of the log. At the precise time the log reaches the discharge rollers 37, 38, the rollers are running at a differential speed to each other so that the log is moved to top center between the rollers. Upon reaching top center, the rollers change to a match speed which holds the log on center, the log then being rotated to place the axially-extending glue stripe at a first angular orientation. The orientation is determined by the log diameter and the fixed dimensions of the path means P on which the log will roll to the receiving means—the accumulator 24 of FIG. 1. Once the log reaches this first angular orientation in the rollers 37, 38, the lower roller 38 stops and the log is ejected. It is also possible to speed up the upper roller 37 to discharge the log, or a combination of different speeds on both rollers to eject the log.

Upon discharge from the rollers, the log will roll down the discharge table 39 constituting the first portion of the path means P to the next piece of converting equipment which is typically an accumulator 24 as shown or conveyor or bander to over wrap the product. If it is desirable to position the tail for even a further downstream operation, such as an orbital log saw having conveyors 25, this is simply to be taken into account when the initial program is set for each log moving from the path means P to the final position. The result of these operations and fixed distances permit the log tail to be positioned to any desired second angular orientation i the receiving means with the only needed input being the new nominal diameter. For example, the angular orientation of the glue stripe in the bucket of the accumulator 24 is advantageously in the upper portion. With a bucket of the form illustrated which has wings extending from about 4 o'clock to about 8 o'clock, the angular orientation of the stripe is advantageously in the sector from about 9 o'clock to about 3 o'clock. This gives a leeway somewhat greater than that used by operators in manually setting the timer. There, the operators felt they had to be within a 90° sector.

On the other hand, the corresponding orientation of the glue stripe in the log trough conveyors 25 is selected to avoid breaking the glue bond upon impact of the servo disc—as contrasted to concern about the log convolution sticking to the support it is advantageous to have the second angular orientation in the larger sector ranging from about 2 o'clock to about 10 o'clock, avoiding the higher, smaller one from about 10 o'clock through 12 o'clock and to 2 o'clock.

INVENTIVE STRUCTURE

Again referring to FIG. 1, the inventive structure includes the table 28 which is supported on the frame 20 and which feeds logs into the nip 39 (see FIG. 5) between the pair of rollers 37, 38. It is this nip 39 which is adjusted when the log nominal diameter is changed. Advantageously, the invention permits changing the log diameter while the machine is running, i.e., on the fly. The quick action of the control means 31 can effect this by virtually instantaneously changing the nip spacing 39 at the first nip between drums 26, 27 upon the appearance of the first different diameter log and the nip spacing of the roller 37, 38 when that same first different diameter log appears a short time later on the table 28.

The rollers 37, 38 are driven, respectively, by motors 40 and 41—see the upper right hand portion of FIG. 2. The spacing of the rollers 37, 38 can be achieved by either a motor 42 and connection 43 operating on the upper roller 37 or by a hand wheel 42'—shown in dotted line at the lower right of FIG. 2. Most advantageously, the spacing of the rollers 37, 38 by changing the location of the roller 37 can be achieved by a signal from the control means 31 which cooperatively sets the spacing of the drums 26, 27. This is done by a motor 43 seen coupled to the motor 41 and operating through a connection 44. Again, it is possible to set the spacing of the rollers 26, 27 by means of a manually operated hand wheel 44', see the upper left hand portion of FIG. 2.

As can be appreciated from a consideration of FIG. 1, the table 28 terminates just short of the line connecting the center lines of the rollers 37, 38. Then, immediately downstream of this imaginary line, a platform 46 is provided which is seen to be pivotally mounted on the frame 20 and establishing the pivotal location of the platform 46 is a cylinder and piston rod unit 47 extending between the platform 46 and the frame 20. The platform 46 is the beginning of a fixed length path extending from the rollers 37, 38 to the receiving bucket: 48 of the accumulator 24.

The accumulator 24 is seen to be equipped with a frame generally designated 20' which includes a closed loop conveyor 49 made up of buckets or cradles like that at 48 for the logs being sequentially received from the tail sealing unit 21. The frame supports a butterfly-type dispenser generally designated 50 which rotates to sequentially deposit one-at-a-time logs in the buckets 48 and includes an entry ramp 51. The closed loop conveyor designated 49 is seen to include at the extreme right a horizontal run 52 which extends over the log saw conveyor troughs 25. Thus, as a bucket 48 in the carrying mode enters the horizontal run 52, it engages at one end a camming post 54 carried by frame member 53 which tilts the bucket to the 48' position so as to discharge a log into the first conveyor trough 55.

Previously, a preceding bucket 48" has engaged along its other end a camming post 56 which has caused it to be cammed or tilted in the fashion indicated at 48"'—this discharging a log into the other log saw trough 57. It will be appreciated that any number of troughs can be employed in the log saw, depending on the size of the saw disc. In the event that more than two troughs are employed, suitable camming or dumping means are used.

ALTERNATIVE CONSTRUCTION

Instead of having the accumulator 24 as being the receiving means at the end of the fixed length path generally designated by the symbol P, the log saw trough conveyor 125 of FIG. 3 may be employed. In such a case, the length of path P is modified so as to deposit each alternative log in a different trough, i.e., one in the trough 155 and the other in the trough 157. Again, the paths are defined of fixed length but inputted to the controller 31 for the alternate logs. Therefore, in the general case, the path P is dimensioned for either one or a plurality of lengths and a suitable width encompassing the variation in nominal log diameters.

In the illustration given, the output ramp 145 is seen to terminate adjacent a carriage 158 which carries a bottom opening bay 159 which, as illustrated in solid line, is over the trough 157. By repositioning the bay to the dotted line showing at 158', the bay 159' is positioned over the trough 155. A suitable means such as an extensible cylinder or quick acting motor means can be employed for the short lateral shifting of the carriage 158 for deposit of logs alternately in the troughs 155, 157.

In FIG. 4, there is a block diagram showing the arrangement of the mechanical/electrical features of the invention. At the extreme left is a rewinder which may be either of the well-known center or surface winding types. A suitable center wind rewinder is seen in co-owned U.S. Pat. No. 3,179,348 while a suitable surface rewinder is seen in co-owned U.S. Pat. No. 4,828,195.

Issuing from the rewinder are logs in sequence which enter the tail sealer previously described in conjunction with the left hand portion of FIG. 1.

The logs issuing sequentially from the tail sealer enter the roller pair 37, 38 which have been adjusted in the spacing to accommodate the log nominal diameters.

Next in line in FIG. 4 is the fixed dimensioned path means which is designated P in both FIGS. 1 and 3. At the end of the path means is provided a receiving means such as the accumulator 25 illustrated in FIG. 1, the log saw trough conveyor 125 illustrated in FIG. 3 or related equipment such as a roll bander.

Still referring to FIG. 4, the control means which is represented in FIG. 1 by the element 31 is seen to have inputs for the nominal diameter when there is a change and the path means dimensions. Still further, there is an input for the cable variables referred to above so as to make sure that the requisite angular orientations are achieved both in the spaced apart rollers 37, 38 and in the receiving means.

DETAILED OPERATION

By the use of a process controller and the addition of a set of driven rollers downstream of the tail locating station, the tail can be oriented to any desired position automatically for any product diameter without operator adjustment. The processor is pre-programmed with the distance to final position where the tail is to be positioned, this is determined by the next downstream apparatus location. The tail seal program then only requires the log diameter which is being loaded into it from the upstream equipment, usually the rewinder. This diameter can be fed automatically to the processor from the winder which is producing the log.

For typically operating speeds of 30 cycles per minute, the drives for the rollers can be start-stop brake motors. For higher speeds it is advantageous to use servo drives which provide better accuracy than the brake motors.

The operation of the tail seal starts with a program being generated based on log diameter, this is typically entered manually or fed to the processor automatically from the upstream processor, typically the rewinder. Once the program is generated the tail seal will automatically operate an load an incoming log, position the log to find the tail, locate the tail and open it, then discharge or convey the log over the glue applicator, and finally press the tail to the log as it passes through, or wind the tail up for a period of time and then discharge it.

The instant invention has a set of independently driven discharge rollers located a distance downstream of the glue applicator. The processor is pre-programmed with the distance between the glue station and the discharge rollers, the roller speeds, acceleration/deceleration times, and the distance to the final position. When the log diameter is fed to the program it completes the calculations and determines what distance the specific diameter log must be rotated between the two discharge rollers so that it results in the tail being located in a specific position in the downstream equipment. Servos drives are preferred due to their higher positioning accuracy, precise speed control, and fast operating speeds. When using servo drives the calculated program is downloaded to the servo drive to run. The servos follow the program and turn the rollers the specific distances to locate the tail in the desired position, and then discharge it.

The automatic calculation and execution eliminates the otherwise needed operator input to set timers or variables for final position. The process provides a precise position location based upon diameter, and can be fed to the program automatically from the upstream equipment. The automatic positioning of the tail eliminates costly set-up time which can now be used for full speed production.

This method and apparatus provides automatic tail positioning for the product into a downstream location with only the input of the product diameter.

Thus the invention provides in the illustrated embodiment, independently driven upper and lower discharge rollers 37, 38 spaced a distance slightly less than the product diameter.

Two rollers automatically adjusted apart to suit the diameter entered. Typical processor for tail positioning calculations and processing—Giddings & Lewis PIC 900 manufactured by Giddings & Lewis, Inc., Fond du Lac, Wis., USA.

While in the foregoing specification a detailed description of the invention has been put down for the purpose of illustration many variations in the details herein given may be made by those skilled in the art without departing from the spirit and scope of the invention.

I claim:

1. A method for handling logs of convolutely wound webs comprising the steps of:

providing a rewinder-tail sealer wherein a glue stripe is applied to a predetermined circumferential location on a partially unwound log and the log rewound by rolling on itself toward and into a pair of spaced-apart drums, providing path means from said roller pair to log receiving means wherein logs sequentially roll in said path means, said path means having fixed dimensions, operating said rewinder-tail sealer to develop logs of a first nominal diameter wherein the roller pair spacing is slightly less than said nominal diameter to enable said roller pair to controllably rotate each log for positioning said glue stripe at a first angular orientation, which in combination with said fixed dimensioned path means enables each log to be received in said receiving means with its glue stripe in a second angular orientation, changing the operation of said rewinder to develop logs of a second nominal diameter, and thereupon correlating said second nominal diameter with said fixed dimensioned path means to enable each second nominal diameter log to be received in said receiving means with its glue stripe in said second angular orientation and adjusting the spacing between said roller pair to be slightly less than said second nominal diameter.

2. The method of claim 1 in which said path means providing step includes providing as said receiving means a plurality of receptacles.

3. The method of claim 2 in which said receptacle providing step includes providing a series of accumulator buckets.

4. The method of claim 3 in which said second angular orientation has each log glue stripe above the bucket.

5. The method of claim 2 in which said receptacle providing step includes providing at least two side-by-side trough conveyors for a log saw.

6. The method of claim 5 in which said second angular orientation is not at the top of each log so as to minimize rupture of the bond achieved by the glue stripe.

7. The method of claim 5 in which said trough conveyors providing steps includes providing a path for each of said trough conveyors, each path being of fixed length but one path being longer than the other and adapted to receive alternate logs, said correlating step including the substantially identical positioning of logs in each of said at least two side-by-side trough conveyors to develop substantially identical second angular orientations of the logs in said trough conveyors.

8. The method of claim 1 in which said correlating step includes providing a process controller, pre-programming said controller with the fixed length of said path means, and providing input means for entering the nominal diameter of a log.

9. The method of claim 8 in which said pre-programming step also includes the following: (a) distance between the means for applying said glue stripe and said roller pair, (b) the speed of said roller pair and (c) the acceleration/deceleration times of said drums.

10. The method of claim 1 in which said spaced-apart drums-providing step includes providing brake-motors.

11. The method of claim 1 in which said spaced-apart drums-providing step includes providing servo motors.

12. Apparatus for handling logs of convolutely wound webs comprising:

a rewinder-tail sealer having means for applying a glue stripe to a predetermined circumferential location on a partially unwound log and the log rewound by rolling on itself toward and into a pair of spaced-apart drums, path means extending from said drum pair to log receiving means wherein logs sequentially roll in said path means, said path means having fixed dimensions, means for operating said rewinder-tail sealer to develop logs of a first nominal diameter wherein the roller pair spacing is slightly less than said nominal diameter to enable said roller pair to controllably rotate each log for positioning said glue stripe at a first angular orientation, which in combination with said fixed dimensioned path means enables each log to be received in said receiving means with its glue stripe in a second angular orientation, means for changing the operation of said rewinder to develop logs of a second nominal diameter, and means for correlating said second nominal diameter with said fixed dimensioned path means to enable each second nominal diameter log to be received in said receiving means with its glue stripe in said second angular orientation, and means for adjusting the spacing between said roller pair to be slightly less than said second nominal diameter.

13. The apparatus of claim 12 in which said path means includes a plurality of receptacles as said receiving means.

14. The apparatus of claim 13 in which said receptacles include a series of accumulator buckets.

15. The apparatus of claim 14 in which said second angular orientation positions each log glue stripe above the bucket.

16. The apparatus of claim 13 in which said receptacle providing step includes providing at least two side-by-side trough conveyors for a log saw.

17. The apparatus of claim 16 in which said second angular orientation is not at the top of each log so as to minimize rupture of the bond achieved by the glue stripe.

18. The apparatus of claim 16 in which said path means includes a path for each of said trough conveyors, each path being of fixed length but one path being longer than the other and adapted to receive alternate logs, said means for correlating including means for substantially identical positioning of logs in each of said trough conveyors to develop substantially identical second angular orientations of the logs in said trough conveyors.

19. The apparatus of claim 12 in which said correlating means includes a process controller, means for pre-programming said controller with the fixed length of said path means, and input means for entering the nominal diameter of a log.

20. The apparatus of claim 19 in which said pre-programming means also includes means for entering: (a) the distance between the means for applying said glue stripe and said roller pair, (b) the speed of said roller pair and (c) the acceleration/deceleration times of said drums.

21. The apparatus of claim 12 in which said spaced-apart drums include brake-motors.

22. The apparatus of claim 12 in which said spaced-apart drums include servo motors.

* * * * *